US011031153B2

(12) United States Patent
Liu et al.

(10) Patent No.: US 11,031,153 B2
(45) Date of Patent: Jun. 8, 2021

(54) WATER TREE RESISTANT CABLES

(71) Applicant: General Cable Technologies Corporation, Highland Heights, KY (US)

(72) Inventors: Jianmin Liu, Carmel, IN (US); Sean William Culligan, Zionsville, IN (US)

(73) Assignee: General Cable Technologies Corporation, Highland Heights, KY (US)

( * ) Notice: Subject to any disclaimer, the term of this patent is extended or adjusted under 35 U.S.C. 154(b) by 41 days.

(21) Appl. No.: 16/181,059

(22) Filed: Nov. 5, 2018

(65) Prior Publication Data

US 2020/0143959 A1 May 7, 2020

(51) Int. Cl.
*H01B 9/02* (2006.01)
*H01B 3/44* (2006.01)

(52) U.S. Cl.
CPC ..... *H01B 9/02* (2013.01); *H01B 3/441* (2013.01)

(58) Field of Classification Search
CPC ..... H01B 9/02; H01B 7/282; H01B 7/2825; H01B 7/2813; H01B 13/24
See application file for complete search history.

(56) References Cited

U.S. PATENT DOCUMENTS 4,130,450 A 12/1978 Bahder et al.
4,612,139 A 9/1986 Kawasaki et al.
5,889,117 A * 3/1999 Flenniken ..... B32B 1/08 525/222
6,274,066 B1 8/2001 Easter
6,291,772 B1 9/2001 Easter et al.
2012/0273253 A1* 11/2012 Nilsson ..... C08F 6/001 174/120 SC
2014/0011029 A1* 1/2014 Brigandi ..... H01B 3/448 428/390
2018/0312662 A1* 11/2018 Chaudhary ..... H01B 3/441
2019/0348193 A1* 11/2019 Zhang ..... H01B 3/34
2020/0043633 A1* 2/2020 D'Agostino ..... H01B 7/0225

FOREIGN PATENT DOCUMENTS

CN 203102961 U 7/2013
CN 203721350 U 7/2014
CN 106349552 A 1/2017
WO 2013112781 A1 8/2013

OTHER PUBLICATIONS

Poole, Robert; Extended European search report, including the European search report and the European search opinion, issued in European Patent Application No. 19206395.6; dated Apr. 3, 2020; 7 pages.

* cited by examiner

*Primary Examiner* — Timothy J Thompson
*Assistant Examiner* — Amol H Patel
(74) *Attorney, Agent, or Firm* — Ulmer & Berne LLP

(57) ABSTRACT

Water tree resistant cables are disclosed. The cables include a water tree resistant insulation shield and water tree resistant conductor shield. The insulation layer can be free of any water tree retardant additives. Methods of making and using the water tree resistant cables are further disclosed.

18 Claims, 1 Drawing Sheet

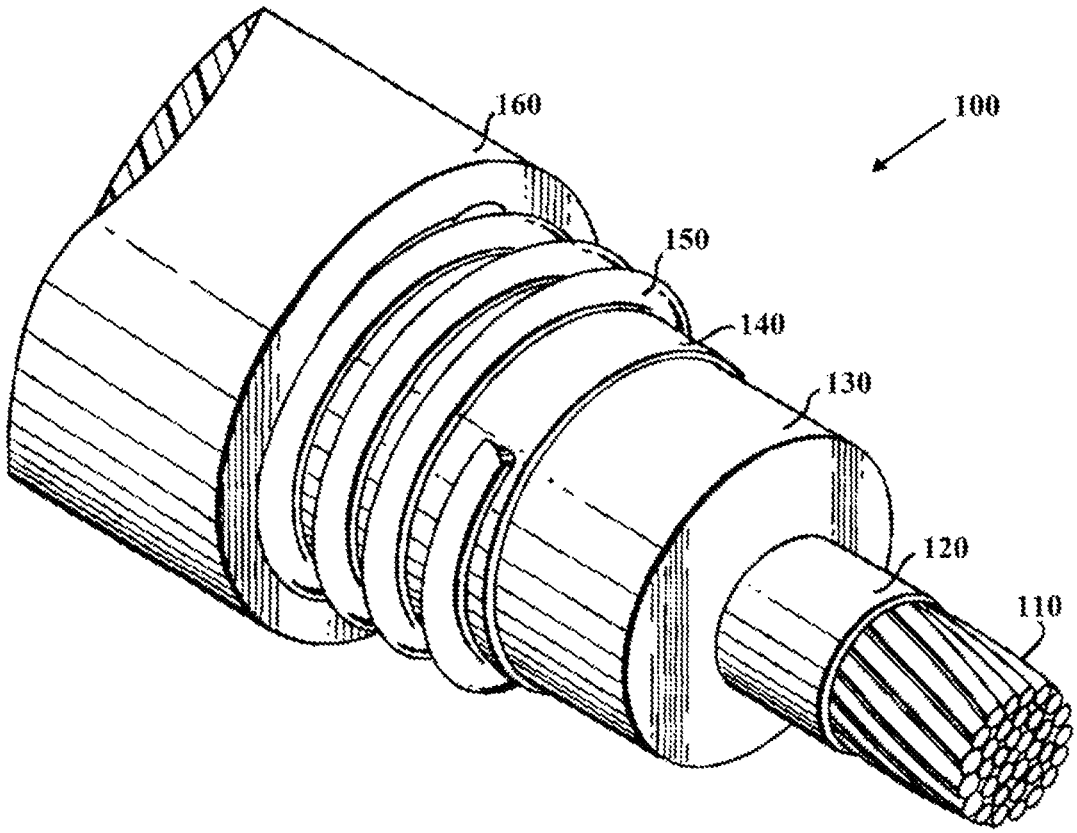
160
100
150
140
130
120
110

WATER TREE RESISTANT CABLES

TECHNICAL FIELD

The present disclosure generally relates to the field of water tree resistant cables.

BACKGROUND

Cables are required to reliably operate under a variety of conditions without suffering from degradation or failure. One particular cause of degradation and failure is water treeing. Water treeing refers to the microscopic intrusion of water into the insulation layer of a cable. With continued water exposure, the microscopic intrusions can progress deeper into the insulation. If the water progresses far enough to bridge through the entirety of the insulation layer, the cable can breakdown due to electrical failure. Conventional water tree resistant cables include insulation layers formed of tree-retardant crosslinked polyethylene ("TR-XLPE"). Cables formed with such TR-XLPE insulation layers, however, have suffered from relatively high costs.

SUMMARY

According to one embodiment, a water tree resistant cable includes one or more conductors, a crosslinked conductor shield surrounding the one or more conductors, an insulation layer surrounding the crosslinked conductor shield, and a crosslinked insulation shield surrounding the insulation layer. The crosslinked conductor shield includes a first water tree retardant additive and a first conductive filler. The insulation layer is substantially free of any water tree retardant additives. The crosslinked insulation shield includes a second water tree retardant additive and a second conductive filler.

According to another embodiment, a water tree resistant cable includes one or more conductors, a crosslinked conductor shield surrounding the one or more conductors, an insulation layer surrounding the crosslinked conductor shield, and a crosslinked insulation shield surrounding the insulation layer. The crosslinked conductor shield includes about 0.1% to about 2% of a first water tree retardant additive and about 35% to about 40% of a first conductive filler. The insulation layer is substantially free of any water tree retardant additives. The crosslinked insulation shield includes about 0.1% to about 2% of a second water tree retardant additive and about 35% to about 40% of a second conductive filler. The water tree resistant cable passes the qualifications of ANSI/CEA S-94-649 (2013).

BRIEF DESCRIPTION OF THE DRAWINGS

FIG. 1 depicts a perspective view of one example of a power cable which resists water treeing.

DETAILED DESCRIPTION

Cables which resist water treeing are disclosed. The cables exhibit improved stripability and improved economics to manufacture. Generally, the cables include water tree resistant insulation shields and water tree resistant conductor shields as an alternative to a water tree resistant insulation layer.

As can be appreciated, a variety of cables can benefit from water tree resistance such as medium voltage power cables and any other cables which are, or may be, exposed to water.

An exemplary cable which can resist water treeing is depicted in FIG. 1. The depicted cable 100 includes a conductor 110, a conductor shield 120, an insulation layer 130, an insulation shield 140, a neutral wire 150, and a cable jacket 160. The conductor shield 120 and the insulation shield 140 are each resistant to water treeing. The cable 100 can resist water treeing even though the insulation layer 130 is not formed of TR-XLPE.

As can be appreciated, certain example water tree resistant cables described herein can vary from the representative structure of cable 100. For example, the conductor 110 can alternatively be formed from a plurality of stranded electrically conductive metal wires or can be a plurality of conductors individually isolated from one another in various embodiments. Suitable cables can also optionally omit the neutral wire 150. Additionally, or alternatively, suitable cables can include additional components or features such as cable separators, braided insulation shields, additional insulation or additional jacket layers, etc. (not shown). According to the disclosure herein, any cable can be modified to be resistant to water treeing by inclusion of a water tree resistant insulation shield and a water tree resistant conductor shield and all such cables are contemplated.

It has been unexpectedly found that cables including water tree resistant conductor shields and water tree resistant insulation shields, but not water tree resistant insulation layers, can be resistant to water treeing. Generally, water tree resistance can be imparted through inclusion of a water tree retardant additive.

Any additive which resists water treeing can be a suitable water tree retardant additive. In certain embodiments, suitable water tree retardant additives can include one or more of polyethylene glycol, ethylene vinyl alcohol, styrene copolymers, non-migrating antistatic agents, and ethylene-butyl acrylate copolymer. Additional examples of suitable water tree retardant additives are disclosed in U.S. Patent App. Pub. No. 2011/0308836 A1 and US Patent App. Pub. No. 2014/0017494 A1, each incorporated herein by reference. Generally, such water tree retardant additives can be included at levels which do not impair any other functions of the cable. For example, the insulation shield and conductor shield can each include about 0.1% to about 10%, by weight of the shield, of a water tree retardant additive or any value between about 0.1% and about 10%, by weight, of the water tree retardant additive including about 0.1% to about 2%, by weight, and 0.2% to about 1%, by weight. As can be appreciated, certain water tree retardant additives can exhibit additional properties. For example, polyethylene glycol can act as a lubricant and can negatively impact the electrical performance of the cable if included in quantities higher than necessary for the desired water tree performance.

In certain embodiments, the water tree retardant additive can be polyethylene glycol such as a polyethylene glycol having a molecular weight of about 16,000 g/mol to about 25,000 g/mol. As can be appreciated, water tree retardant additives can also be commercially obtained. For example, a suitable water tree retardant additive can be Polyglykol 20000 from Clariant International (Muttenz, Switzerland).

As can be appreciated, the formation of cables which resist water treeing without requiring the insulation layer to be water tree resistant can have numerous benefits. For example, such cables can offer substantial cost savings to customers and can improve manufacturing flexibility by allowing for the use of a conventional insulation layer such as, for example, an unfilled XLPE insulation layer. It has also been unexpectedly discovered that formation of water tree resistant cables formed without water tree insulation layers can exhibit improved stripability because the insulation layer has reduced adhesion force to the cable shields. Accordingly, the cable insulation can be removed easier than conventional water tree resistant cables.

The conductor shield and the insulation shield (collectively, "cable shields") can generally be formed as known in the art with the further inclusion of a water tree retardant additive. For example, suitable cable shields can be formed by crosslinking a suitable polymer, such as ethylene vinyl acetate ("EVA"), ethylene-octene copolymer, or ethylene-butene copolymer, and a relatively large loading level of a conductive additive such as carbon black or carbon nanotubes. In certain embodiments, suitable cable shields can include about 40% to about 75%, by weight, polymer and about 25% to about 50%, by weight, conductive filler. As can be appreciated, any ranges within such values can also be suitable including, for example, about 50% to about 70%, by weight, polymer; about 55% to about 65%, by weight, polymer, or about 55% to about 60%, by weight, polymer. Such cable shields can include 30% to about 45%, by weight, conductive filler; or about 35% to about 40%, by weight, conductive filler. In certain embodiments, the polymer can be EVA and the conductive filler can be a carbon black.

In certain embodiments, suitable EVA polymers can include EVA polymers having a vinyl acetate content of about 18% to about 35% and a melt index of about 23 to about 43. As can be appreciated however, other known EVA polymers with other amounts of vinyl acetate, such as those including higher amounts of vinyl acetate (e.g., about 50% to about 70% vinyl acetate), can alternatively be suitable. Examples of commercially available EVA polymers which can be suitable include Escorene® LD-723 EVA and Escorene® LD-783 CD EVA, each available from ExxonMobil (Irving, Tex.).

Suitable carbon blacks can also vary widely depending upon the desired electrical properties and mechanical properties. In certain embodiments, examples of suitable carbon blacks can include carbon blacks having an Oil Absorption Number ("OAN") of about 100 $cm^3$/100 g to about 200 $cm^3$/100 g, including, carbon blacks with an OAN of about 110 $cm^3$/100 g to about 130 $cm^3$/100 g and carbon blacks with an OAN of about 160 $cm^3$/100 g to about 180 $cm^3$/100 g. Examples of commercially available carbon blacks which can be suitable include Vulcan® XC-200 carbon black from Cabot (Boston, Mass.) and Conductex® 7055 Ultra carbon black from Birla Carbon (Marietta, Ga.).

As can be appreciated, because the insulation layer is not required to be water treeing resistant, the insulation layer can be formed of variety of suitable materials. For example, in certain embodiments, the insulation layer can be formed from one, or more, polymers such as a polyolefin (e.g., low-density polyethylene ("LDPE") which can be crosslinked. The insulation layer can vary in size depending on the voltage rating of the cable and can be, for example, about 2.54 mm (0.10 inches) thick to about 6.35 mm (0.25 inches) thick for a 1/0 American Wire Gauge ("AWG") cable (e.g., a cable having a diameter of 8.251 mm) that has a voltage rating of about 10 kV to about 20 kV. One skilled in the art will appreciate that other suitable materials and constructions could also be used to form the insulation layer. In certain embodiments, the insulation layer can be unfilled XLPE. As used herein, unfilled means that the polymer does not include filler but can include small quantities of additives such as antioxidants (e.g., about 5% or less additives).

An unfilled XLPE insulation layer can generally be formed as known in the art. For example, low-density polyethylene ("LDPE") can be extruded with a crosslinking agent to form an unfilled XLPE insulation layer.

Generally, the insulation shield, conductor shield, and insulation layer can each be crosslinked using any known crosslinking method such as peroxide curing, silane crosslinking, e-beam curing, etc. as known in the art. In certain embodiments, each of the insulation shield, the conductor shield, and the insulation layer can be cured through inclusion of a suitable peroxide.

As can be appreciated, the insulation shield, the conductor shield, and insulation layer can include various other components in certain embodiments. For example, one or more processing aids, antioxidants, stabilizers, and the like can be included.

For example, a processing aid can be included to improve processability by forming a microscopic dispersed phase within a polymer carrier. During processing, the applied shear can separate the processing aid (e.g., processing oil) phase from the carrier polymer phase. The processing aid can then migrate to a die wall to gradually form a continuous coating layer to reduce the backpressure of the extruder and reduce friction during extrusion. The processing oil can generally be a lubricant, such as ultra-low molecular weight polyethylene (e.g., polyethylene wax), stearic acid, silicones, anti-static amines, organic amides, ethanolamides, zinc stearate, palmitic acids, calcium stearate, zinc sulfate, oligomeric olefin oil, or combinations thereof.

In certain embodiments, the cables described herein can alternatively be substantially free of any lubricant, processing oil, or processing aids. As used herein, "substantially free" means that the component is present in quantities of less than about 0.1% by weight, or alternatively, that the component is not detectable with current analytical methods.

According to certain embodiments, suitable antioxidants can include, for example, amine-antioxidants, such as 4,4'-dioctyl diphenylamine, N,N'-diphenyl-p-phenylenediamine, and polymers of 2,2,4-trimethyl-1,2-dihydroquinoline; phenolic antioxidants, such as thiodiethylene bis[3-(3,5-di-tert-butyl-4-hydroxyphenyl)propionate], 4,4'-thiobis(2-tert-butyl-5-methylphenol), 2,2'-thiobis(4-methyl-6-tert-butylphenol), benzenepropanoic acid, 3,5-bis(1,1-dimethylethyl) 4-hydroxy benzenepropanoic acid, 3,5-bis(1,1-dimethylethyl)-4-hydroxy-C13-15 branched and linear alkyl esters, 3,5-di-tert-butyl-4hydroxyhydrocinnamic acid C7-9-branched alkyl ester, 2,4-dimethyl-6-t-butylphenol tetrakis{methylene-3-(3',5'-ditert-butyl-4'-hydroxyphenol) propionate}methane or tetrakis{methylene3-(3',5'-ditert-butyl-4'-hydrocinnamate}methane, 1,1,3tris(2-methyl-4-hydroxyl-5-butylphenyl)butane, 2,5, di t-amyl hydroquinone, 1,3,5-trimethyl2,4,6tris(3,5di tert butyl-4-hydroxybenzyl) benzene, 1,3,5tris(3,5di-tert-butyl-4-hydroxybenzyl)isocyanurate, 2,2-methylene-bis-(4-methyl-6-tert butyl-phenol), 6,6'-di-tert-butyl-2,2'-thiodi-p-cresol or 2,2'-thiobis(4-methyl-6-tert-butylphenol), 2,2-ethylenebis(4,6-di-t-butylphenol), triethyleneglycol bis{3-(3-t-butyl-4-hydroxy-5methylphenyl)propionate}, 1,3,5-tris(4tert-butyl-3-hydroxy-2,6-dimethylbenzyl)-1,3,5-triazine-2,4,6-(1H,3H, 5H)trione, 2,2-methylenebis{6-(1-methylcyclohexyl)-p-cresol}; sterically hindered phenolic antioxidants such as pentaerythritol tetrakis(3-(3,5-di-tert-butyl-4-hydroxyphenyl)propionate); hydrolytically stable phosphite antioxidants such as tris(2,4-di-tert-butylphenyl)phosphite; toluimidazole, and/or sulfur antioxidants, such as bis(2-methyl-4-(3-n-alkylthiopropionyloxy)-5-t-butylphenyl)sulfide, 2-mercaptobenzimidazole and its zinc salts, pentaerythritol-tetrakis(3-lauryl-thiopropionate), and combinations thereof.

In certain embodiments, a stabilizer can be included to improve the compatibility of the components included in the cable shields. In such embodiments, suitable stabilizers can include mixed metal stabilizers such as those based on calcium and zinc chemistries. For example, a calcium hydroxide metal stabilizer or a calcium-zinc metal carboxylate stabilizer can be used in certain embodiments. In certain embodiments, commercial stabilizers such as Therm-Chek® stabilizers produced by Ferro Corp. (Mayfield Heights, Ohio) can also be used.

In certain embodiments, a scorch retardant can be included to improve resistance to scorching during extrusion and improve thermal stability. Scorch retardants are generally known and include, for example, sterically hindered aromatic compounds, hydroperoxides, vinyl monomers, nitrites, aromatic amines, phenolic compounds, mercaptothiazole compounds, sulphides, hydroquinones, dialkyl dithiocarbamate compounds, tetramethylpiperidyloxy ("TEMPO") compounds, and nitroxides. In certain embodiments, the scorch retardant compound can be a sterically hindered aromatic compound.

The conductor, or conductive elements, can generally be formed of any suitable electrically conductive metal such as, copper, aluminum, a copper alloy, an aluminum alloy (e.g. an aluminum-zirconium alloy), or any other conductive metal. As will be appreciated, the conductor can be solid, or can be twisted and braided from a plurality of smaller conductors. In certain embodiments, a braided conductor can advantageously be selected to increase the electrical conductivity and flexibility of the cable compared to a similar cable formed with solid conductors. In certain embodiments, the conductors can comply with the requirements of American Society for Testing and Materials ("ASTM") standard B174.

Generally, each conductor can be of any suitable wire gauge. For example, in certain embodiments, the conductors can have a diameter between about 4.115 mm (e.g., 6 American Wire Gauge ("AWG") or 26 kcmil) and about 2.84 cm (e.g., 1250 kcmil). As can be appreciated, equivalent international gauges, such as those expressed in square mm, can alternatively be suitable. As can be appreciated, selection of the wire gauge can vary depending on factors such as the desired cable operating distance, the desired electrical performance, and physical parameters such as the thickness of the cable. Cables with increased ampacity or voltage requirements can require thicker gauge conductors but can be less flexible as a result.

The cable jacket, surrounding the conductor assemblies, can generally be formed from any suitable material. For example, suitable cable jackets can be formed of a polyolefin (e.g., a polyethylene such as LDPE) in certain embodiments. The cable jacket can be thermoplastic or thermoset and can optionally be semi-conductive. Additionally, the cable jacket can include any of the additives and fillers included in the cable shield or insulation layers. In certain embodiments, the cable jacket can have a thickness of about 0.5 mm to about 5 mm, about 0.6 mm to about 3.5 mm, or about 0.76 mm to about 2.54 mm.

Generally, each of the layers can have any suitable thickness as known in the art. For example, for a medium-voltage cable, the conductor shield can have a thickness of about 0.127 mm (0.005 inches) to about 6.35 mm (0.25 inches), the insulation layer can have a thickness of about 2.54 mm (0.10 inches) to about 12.7 mm (0.5 inches), and the insulation shield layer can have a thickness of about 0.381 mm (0.015 inches) to about 1.14 mm (0.045 inches). As can be appreciated however, other thicknesses are also possible for cables designed to conduct different amounts of voltages.

According to certain embodiments, a colorant can be added to certain layers such as the cable jacket. Suitable colorants can include, for example, carbon black, cadmium red, iron blue, or a combination thereof. As can be appreciated, any other known colorant can alternatively be added.

Generally, the cables described herein can be formed using an extrusion process. In a typical extrusion method, an optionally heated conductor can be pulled through a heated extrusion die, such as a cross-head die, to apply a layer of melted composition onto the conductor. Upon exiting the die, if the composition is adapted as a thermoset composition, the conducting core layer may be passed through a heated vulcanizing section, or continuous vulcanizing section and then a cooling section, such as an elongated cooling bath, to cool. Multiple layers (e.g., insulation layer and the insulation shield) can be applied through consecutive extrusion steps in which an additional layer is added in each step. Alternatively, with the proper type of die, multiple layers of the composition can be applied simultaneously. In certain embodiments, the cable jacket can be extruded. In other certain embodiments, a preformed cable jacket can be pulled around the assembly of conductors.

As can be appreciated, resistance to water treeing can enable the cables described herein to be used in environments where the cable is or may be exposed or submerged in water. For example, the cables described herein can be suitable for marine applications. In certain embodiments, the cables described herein can be suitable for applications requiring about 1 kV to about 65 kV in certain embodiments, or a voltage class ranging from about 5 kV to about 46 kV in certain embodiments

EXAMPLES

Tables 1 and 2 depict sample compositions used to form insulation shields and conductor shields for example water tree resistant cables. Table 1 specifically depicts sample compositions used to form insulation shields while Table 2 depicts sample compositions used to form conductor shields. Each of the components in Tables 1 and 2 are listed by weight percentage. In addition to the components listed, each of the sample compositions further included small amounts of various additives. For example, each of the compositions included about 1% to about 5% wax, about 0.01% to about 0.15% of a scorch retardant, about 0.1% to about 0.75% of an antioxidant, and about 0.75% to about 1.25% of a peroxide crosslinking agent. The sample compositions used to form insulation shields further included about 0.50% to about 1.0% zinc stearate.

TABLE 1

| Component | Sample A | Sample B |
|---|---|---|
| Ethylene Vinyl Acetate (EVA) | 57% | 57% |
| Carbon black | 37% | 37% |
| Water Tree Retardant Additive (Polyethylene glycol) | — | 0.2% |

Sample A is a comparative sample composition because it does not include a water tree retardant additive. Sample B is an inventive sample composition because it includes a water tree retardant additive and can be used to form a water tree resistant insulation shield.

TABLE 2

| Component | Sample C | Sample D |
|---|---|---|
| Ethylene Vinyl Acetate (EVA) | 60% | 60% |
| Carbon black | 37% | 37% |
| Water Tree Retardant Additive (Polyethylene glycol) | — | 0.5% |

Sample C is a comparative sample composition because it does not include a water tree retardant additive. Sample D is an inventive sample composition because it includes a water tree retardant additive and can be used to form a water tree resistant conductor shield.

TABLE 3

| Example | Insulation Shield | Conductor Shield | Insulation |
|---|---|---|---|
| 1 | Sample A | Sample D | XLPE |
| 2 | Sample B | Sample D | XLPE |
| 3 | Sample A | Sample C | XLPE |
| 4 | Sample A | Sample C | TR-XLPE |

TABLE 4

| Example | Test #1 (Prior to Cyclic Aging) | Test #2 (Prior to Cyclic Aging) | Test #3 (After Cyclic Aging) | Test #4 (After Cyclic Aging) | Test #5 (120 Day) | Test #6 (180 Day) | Test #7 (360 Day) | Adhesion value (lower is better) (Newtons) Max | Min |
|---|---|---|---|---|---|---|---|---|---|
| 1 | 1860, 1860, 1820 | 2671, 2514, 2671 | 980, 1020, 1180 | 2200, 2043, 2357 | 620, 540, 540 | 460, 420, 700 | 380, 460, 380 | — | — |
| 2 | 1340, 1300, 1300 | 2986, 2829, 2200 | 940, 1260, 1140 | 1886, 2671, 2043 | 900, 820, 940 | 940, 820, 860 | 700, 860, 580 | 61.83 N | 52.04 N |
| 3 | 1220, 1340, 1300 | 2514, 2829, 2829 | 660, 1100, 780 | 2200, 2414, 1729 | 700, 420, 580 | 580, 580, 540 | 620, 500, 620 | 66.72 N | 57.38 N |
| 4 | 860, 820, 820 | 2829, 2829, 2671 | 1500, 1620, 1620 | 2043, 2200, 2357 | 940, 1260, 900 | 700, 900, 780 | 700, 700, 780 | 68.95 N | 53.38 N |
| Requirement | 620 | 1200 | 660 | 1200 | 660 | 580 | 380 | — | — |

Table 3 depicts Examples 1 to 4 of water tree resistant cables formed using cable shields formed of various combinations of Samples A to D and insulation formed of either XLPE or XLPE with a tree-resistant additive (TR-XLPE). The XLPE insulation layers were formed with low-density polyethylene, an antioxidant, a peroxide crosslinking agent, and for TR-XLPE, polyethylene glycol. The conductor shield had a thickness of 0.015 inches, the insulation layer a thickness of 0.175 inches, and the insulation shield layer a thickness of 0.045 inches.

Table 4 depicts the results of testing Examples 1 to 4. The example cables were evaluated for water tree resistance as well as adhesion (stripability). Water tree resistance was evaluated using ANSI/CEA S-94-649 (2013). Adhesion force was measured in accordance to ICEA T-27-581-2016. Test #1 was a high voltage breakdown test of cable samples prior to thermal conditioning. Test #2 was a hot impulse breakdown test of cable samples prior to thermal conditioning. Test #3 was a high voltage breakdown test conducted after 14 thermal load cycles where each load cycle was a 24 hour period during which the current was on for the first 8 hours and off for the remaining 16 hours. Test #4 was a hot impulse breakdown test conducted after 14 thermal load cycles where each load cycle was a 24 hour period during which the current was on for the first 8 hours and off for the remaining 16 hours. Tests #5 to #7 were high voltage breakdown tests of cable samples after 120, 180, and 360 days of accelerated water tree test aging. A cable passing the qualifications of ANSI/CEA S-94-649 (2013) is considered to be resistant to water treeing. Adhesion force measured by removing, at a 90° angle, a 0.5 inch wide insulation strip from a 22-inch long cable sample. All testing was performed without a cable jacket.

As depicted in Table 4, Example 2, including both a water tree resistant insulation shield and water tree resistant conductor shield, exhibited superior properties and passed the requirements for a water tree resistant cable while also exhibiting lower adhesion values than conventional water tree resistant cables (Example 4). As can be appreciated, Example 4 depicts a conventional water tree resistant cable including a water tree resistant insulation layer but no water tree resistant insulation and conductor shields. Example 3 is a conventional cable with no water tree resistant components.

As used herein, all percentages (%) are percent by dry weight of the total composition, also expressed as weight/weight %, % (w/w), w/w, w/w % or simply %, unless otherwise indicated. Also, as used herein, the terms "wet" refers to relative percentages of the composition in a dispersion medium (e.g. water); and "dry" refers to the relative percentages of the dry composition prior to the addition of a dispersion medium. In other words, the dry percentages are those present without taking the dispersion medium into account. Wet admixture refers to the composition with the dispersion medium added. "Wet weight percentage", or the like, is the weight in a wet mixture; and "dry weight percentage", or the like, is the weight percentage in a dry composition without the dispersion medium. Unless otherwise indicated, percentages (%) used herein are dry weight percentages based on the weight of the total composition.

The dimensions and values disclosed herein are not to be understood as being strictly limited to the exact numerical values recited. Instead, unless otherwise specified, each such dimension is intended to mean both the recited value and a functionally equivalent range surrounding that value.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. A water tree resistant cable comprising:

one or more conductors;

a crosslinked conductor shield surrounding the one or more conductors and comprising about 0.1% to about 10%, by weight, of a first water tree retardant additive and a first conductive filler;

an insulation layer surrounding the crosslinked conductor shield, the insulation layer substantially free of any water tree retardant additives; and a crosslinked insulation shield surrounding the insulation layer and comprising about 0.1% to about 10%, by weight, of a second water tree retardant additive and a second conductive filler.

2. The water tree resistant cable of claim 1 passes the qualifications of ANSI/ICEA S-94-649 (2013).

3. The water tree resistant cable of claim 1 further comprises a cable jacket at least substantially surrounding the crosslinked insulation shield.

4. The water tree resistant cable of claim 1, wherein the first water tree retardant additive and the second water tree retardant additive are identical.

5. The water tree resistant cable of claim 1, wherein the first water tree retardant additive and the second water tree retardant additive each comprise a polyethylene glycol.

6. The water tree resistant cable of claim 1, wherein the first conductive filler and the second conductive filler are identical.

7. The water tree resistant cable of claim 1, wherein the first conductive filler and the second conductive filler each comprise carbon black.

8. The water tree resistant cable of claim 1, wherein the insulation layer comprises a crosslinked polymer.

9. The water tree resistant cable of claim 1, wherein the insulation layer comprises crosslinked polyethylene ("XLPE").

10. The water tree resistant cable of claim 9, wherein the crosslinked insulation layer is substantially free of any filler.

11. The water tree resistant cable of claim 1, wherein the crosslinked conductor shield and the crosslinked insulation shield each comprise crosslinked ethylene vinyl acetate ("EVA").

12. The water tree resistant cable of claim 1, wherein the crosslinked conductor shield comprises about 0.2% to about 1%, by weight, of the first water tree retardant additive; and the crosslinked insulation shield comprises about 0.2% to about 1%, by weight, of the second water tree retardant additive.

13. The water tree resistant cable of claim 1, wherein the crosslinked conductor shield comprises about 35% to about 40%, by weight, of the first conductive filler; and the crosslinked insulation shield comprises about 35% to about 40% by weight, of the second conductive filler.

14. The water tree resistant cable of claim 1 is designed to conduct from about 5,000 volts to about 46,000 volts.

15. The water tree resistant cable of claim 1, wherein:

the crosslinked conductor shield has a thickness of about 0.127 mm to about 6.35 mm;

the insulation layer has a thickness of about 2.54 mm to about 1.27 cm; and the crosslinked insulation shield layer has a thickness of about 0.381 mm to about 1.14 mm.

16. A water tree resistant cable comprising:

one or more conductors;

a crosslinked conductor shield surrounding the one or more conductors and comprising about 0.1% to about 2% of a first water tree retardant additive and about 35% to about 40% of a first conductive filler;

an insulation layer surrounding the crosslinked conductor shield, the insulation layer substantially free of any water tree retardant additives;

a crosslinked insulation shield surrounding the insulation layer and comprising about 0.1% to about 2% of a second water tree retardant additive and about 35% to about 40% of a second conductive filler; and wherein the water tree resistant cable passes the qualifications of ANSI/ICEA S-94-649 (2013).

17. The water tree resistant cable of claim 16 further comprises a cable jacket at least substantially surrounding the crosslinked insulation shield.

18. A water tree resistant cable comprising:

one or more conductors;

a crosslinked conductor shield surrounding the one or more conductors and comprising a first water tree retardant additive and a first conductive filler;

an insulation layer surrounding the crosslinked conductor shield, the insulation layer substantially free of any water tree retardant additives; and a crosslinked insulation shield surrounding the insulation layer and comprising a second water tree retardant additive and a second conductive filler;

wherein the water tree resistant cable has a maximum adhesion strength of about 62 N or less when tested in accordance to ICEA T-27-581-2016.

* * * * *